US011306731B2

(12) United States Patent
Chen et al.

(10) Patent No.: US 11,306,731 B2
(45) Date of Patent: Apr. 19, 2022

(54) FAN BODIES WITH PRESSURE REGULATING CHAMBERS

(71) Applicant: Hewlett-Packard Development Company, L.P., Spring, TX (US)

(72) Inventors: Shih-Han Chen, Taipei (TW); Hung-Wen Chang, Taipei (TW); Ai-Tsung Li, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/011,010

(22) Filed: Sep. 3, 2020

(65) Prior Publication Data

US 2022/0065264 A1 Mar. 3, 2022

(51) Int. Cl.
*F04D 29/42* (2006.01)

(52) U.S. Cl.
CPC ..... *F04D 29/4226* (2013.01)

(58) Field of Classification Search
CPC ..... F04D 29/4226; F04D 29/665; F05D 2260/963
See application file for complete search history.

(56) References Cited

U.S. PATENT DOCUMENTS

| | | | | |
|---|---|---|---|---|
| 7,883,312 | B2 * | 2/2011 | Eguchi | F04D 29/162 415/119 |
| 9,341,195 | B2 * | 5/2016 | Wang | F04D 29/703 |
| 9,371,840 | B2 * | 6/2016 | Fujita | F04D 29/056 |
| 9,518,584 | B2 * | 12/2016 | Chen | F04D 25/0613 |
| 2005/0274497 | A1 | 12/2005 | Huang et al. | |
| 2014/0113539 | A1 * | 4/2014 | Dickinson | H05K 5/06 454/184 |
| 2016/0209893 | A1 | 7/2016 | Yuan et al. | |
| 2019/0264695 | A1 | 8/2019 | Tsukamoto et al. | |

FOREIGN PATENT DOCUMENTS

| | | |
|---|---|---|
| CN | 2752850 | 1/2006 |
| JP | 5442683 | 3/2014 |

* cited by examiner

*Primary Examiner* — Ninh H. Nguyen
(74) *Attorney, Agent, or Firm* — Brooks Cameron & Huebsch PLLC

(57) ABSTRACT

Examples herein relate to fan bodies with pressure regulating chambers. For instance, in some examples a fan body can define an outlet, an inlet, a fan chamber that is in fluidic communication with the inlet and the outlet, and a hollow pressure regulating chamber having an opening that is in fluidic communication with the fan chamber.

17 Claims, 5 Drawing Sheets

FAN BODIES WITH PRESSURE REGULATING CHAMBERS

BACKGROUND

Electronic devices include laptop computers, tablets, desktop computers, mobile phones, etc. that can transmit or modify energy to perform, or assist in the performance of tasks. Electronic devices may include various components that generate heat during operation of the electronic device. Examples of components that generate heat include integrated circuit chips (IC)s, central processing units (CPU)s, graphical processing units (GPU)s, and powers sources, among other types of heat-generating components.

Electronic devices may include a fan. A fan can be utilized to produce a flow within a fluid. For instance, a fan can cause air to be drawn into an electronic device, circulate the air within the electronic device, and expel the air from the electronic device to cool the electronic device.

DETAILED DESCRIPTION

Figure 1:
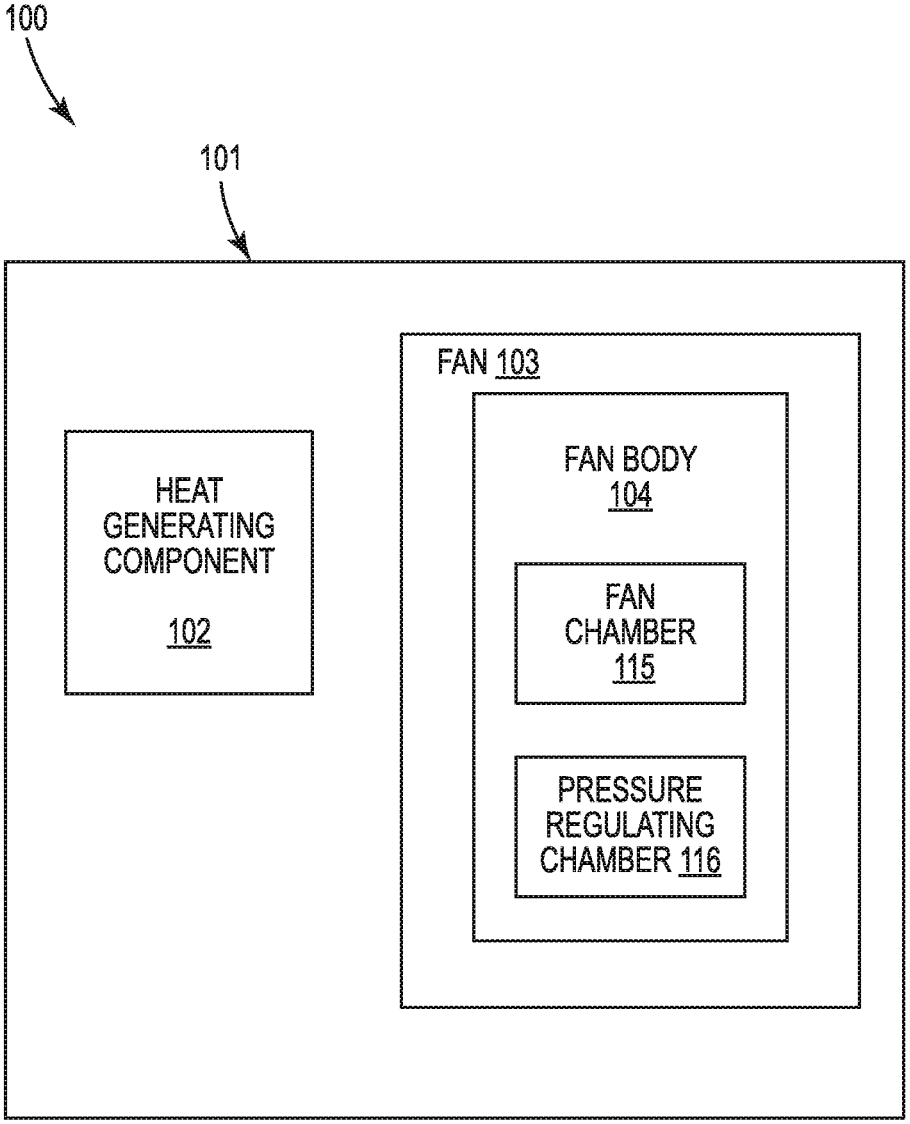
FIG. 1 is a diagram of an example electronic device including a fan with a pressure regulating chamber.

As mentioned, electronic devices may generate heat. For instance, electronic devices may generate thermal radiation (i.e., heat) in the process of transmitting or modifying energy to perform or assist in tasks. For example, as electricity passes through wires and across circuitry in the electronic device, inherent resistance in the wires and circuitry can give rise to ohmic heating in the system, thereby producing thermal radiation (i.e., heat). Although the generation of thermal radiation in electronic devices can be unavoidable, various methodologies of mitigating thermal radiation in electronic devices can be employed.

For example, fans can be utilized in electronic devices to mitigate thermal radiation. As used herein, "fan" is a device that can operate to produce flow within a fluid (e.g., air). However, electronic devices such as laptops may become thinner (e.g., having a smaller profile/outer footprint or dimensions) based on design preferences/an application of the electronic device. As electronic devices become thinner, operation of the electronic devices may be impacted. For instance, an amount of space between a fan and a surrounding component may become smaller. As a result, a pressure gradient surrounding the fan may be increased during operation of the fan. Pressure as used here refers a force applied (e.g., perpendicular) to a surface of an object per unit area over which the force is applied. A pressure gradient as used herein refers to a physical quantity that describes in which direction and at what rate the pressure increases the most rapidly around a particular location such as a point in/near a fan chamber. An increased pressure gradient in a fan chamber can lead to a corresponding increase in an amount of noise produced by the fan during operation of the fan. Such increased fan noise can lead to a negative experience for an end user of the electronic device.

As such, the disclosure herein is directed to pressure regulating chambers. For instance, a fan body can include a pressure regulating chamber as detailed, herein. The pressure regulating chamber can be in fluidic communication with a fan chamber. As such, pressure regulating chamber can provide additional surface area/volume in addition to the surface area/volume of the fan chamber. The additional surface area/volume provided by the pressure regulating chamber can reduce a pressure gradient in/near the fan chamber for instance by reducing a pressure of a fluid such as air flowing along a fluid flow path in the fan chamber and thereby lower an amount of noise during operation of a fan, as detailed herein. For example, pressure regulating chambers can provide a 10 decibel or greater reduction in noise during high frequency operation of a fan due to a volume, relative dimensions, and/or curvature of the pressure regulating chambers, as detailed herein. In this regard, each fan can operate under a higher load (e.g., a higher fan speed) with a reduce amount of noise as compared to other approaches that do not include a pressure regulating chamber.

FIG. 1 is a diagram of an example electronic device 100 including a fan with a pressure regulating chamber 116. As illustrated in FIG. 1, the electronic device 100 can include a heat-generating component 102 and a fan 103 including the pressure regulating chamber 116.

The electronic device 100 can be a tablet, a laptop computer, a desktop computer, a display or monitor, or combinations thereof. In some examples, the electronic device 100 can be an all-in-one (AIO) electronic device. As used herein, an AIO electronic device refers to a computer which integrates the internal components into the same housing as the display and can offer a touch input functionality of the tablet devices while also providing a processing power and a viewing area of desktop computing systems.

The electronic device 100 can include a housing 101. The housing 101 can form an exterior surface of the electronic device 100. The housing 101 can be formed of fabric, metal, natural materials such as wood, and/or plastic, among other suitable materials. The housing 101 can be a unitary housing or the housing 101 can include a plurality of sections such as a plurality of sections held together by a hinge or other coupling member (e.g., in the instance of a laptop).

The heat-generating component 102 can be an integrated circuit chip (IC), central processing unit, graphical processing unit, and/or powers source, among other components that generate heat during operation of the electronic device 100. A power source refers to a source of direct current (DC) and/or a source of alternating current (AC). Examples of power sources include batteries, AC/DC power converters, and/or DC/AC power converters, among other types of power sources.

As mentioned, the fan 103 refers to a device that can operate to produce flow within a fluid (e.g., air). For instance, a fan 103 can impart a force on a fluid and cause a flow within the fluid by way of rotation of a rotational element (e.g., an impeller). An impeller can refer to an assembly of blades and hub. For instance, blades can be coupled to a central hub and, when the hub and the blades are rotated, the blades can cause a flow of a fluid in a given direction. The fluid can flow along a fluid flow path. For example, a fluid flow path can extend from an inlet of the fan to an outlet of the fan, as detailed herein.

The fan 103 can include a fan body 104. The fan body 104 can form a surface of the fan 103. The fan body 104 can be formed of fabric, metal, natural materials such as wood, and/or plastic, among other suitable materials. The fan body 104 can be a unitary member and/or can include a plurality of sections such as a plurality of sections held together by a hinge or other coupling member.

Figure 3:
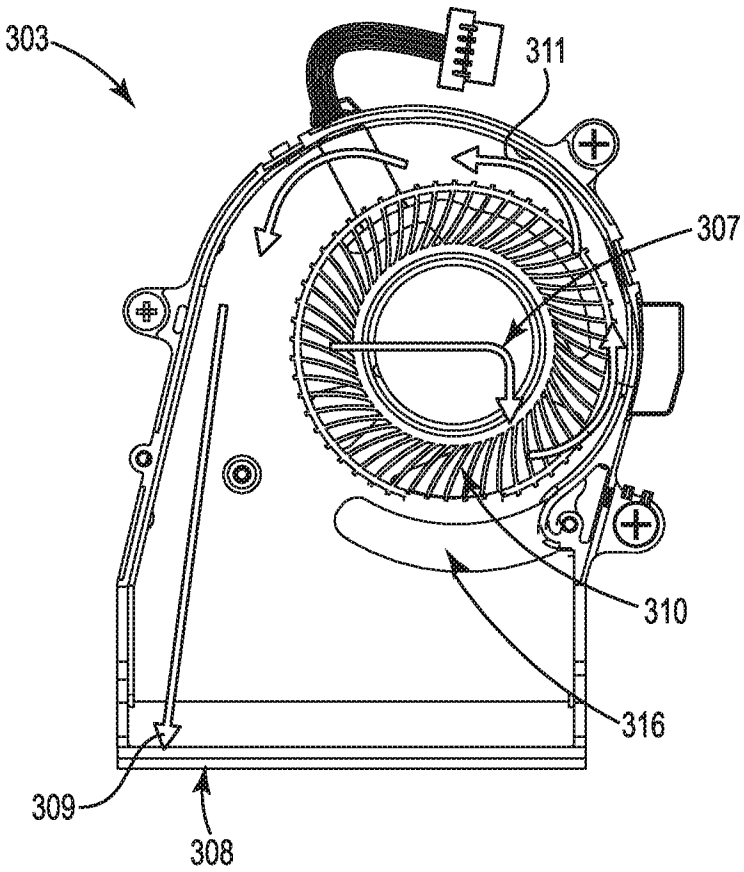
FIG. 3 is an additional view of an example fan including a pressure regulating chamber.

The fan body 104 can include a fan chamber 115. As used herein, a fan chamber refers to a volume defined by a surface of the fan body 104 that is sized to receive and store a rotational element (e.g., impeller 310 as illustrated in FIG. 3) or other type of element that can impart a flow in fluid. The fan chamber 115 can have a length, a width, and a height, that are each larger than a corresponding length, width, and height of the rotational element that can impart a flow in fluid. Thus, the fan chamber 115 can be comparatively larger than a rotational element to permit the rotational element to rotate in the fan chamber 115 and thereby impart a flow on a fluid in the fan chamber 115. The flow of fluid can be used to cool the electronic device 100.

However, as mentioned, operation of the fan 103 can cause a pressure gradient to occur within the fan 103. For instance, an amount of pressure can be increased within the fan body 104 and/or within the fan chamber 115 relative to an amount of pressure elsewhere in the electronic device 100 and/or in an environment surrounding the fan 103. For example, air entering the fan 103 can be compressed by rotation or other motion of an impeller in the fan and thereby a pressure gradient can be formed along a fluid flow path within the fan 103. Such pressure gradient can, in some other approaches such as those that do not include a pressure regulating chamber, lead to an unwanted level of fan noise during operation of the fan. For instance, in some approaches an amount of noise produced by a fan during operation can be particularly elevated during high frequency operation of the fan. As used herein, high frequency operation refers to operation of the fan in a range from 6,000 rotations per minute to 10,000 rotations per minute.

As such, the fan body 104 can include the pressure regulating chamber 116. The pressure regulating chamber 116 can, as detailed herein, be disposed entirely within the fan body 104 so the pressure regulating chamber 116 is not visible from the outside of the fan body 104. For instance, the pressure regulating chamber 116 can be located within the fan body 104 along a fluid flow path that extends from an inlet to the fan chamber 115 to an outlet in the fan chamber 115. That is, as used herein a pressure regulating chamber refers to a cavity formed in a fan body that is in fluidic communication with the fan chamber 115. As detailed herein, the pressure regulating chamber 116 can be hollow. As used herein, being hollow refers to an absence of structure within an internal volume of the pressure regulating chamber.

As used herein, being in fluidic communication refers to a connection that allows a fluid (e.g., air) to pass between the fan chamber 115 and the pressure regulating chamber 116. For example, air can be transported from an inlet in the fan chamber 115 to an opening in the pressure regulating chamber 116 and/or from the opening in the pressure regulating chamber 116 to an outlet in the fan chamber 115. Permitting fluidic flow between the pressure regulating chamber 116 and the fan chamber 115 can reduce a pressure gradient in the fan 103 (e.g., reduce a differential in pressure and/or reduce a maximum amount of pressure) during operation of the fan, as compared to other approaches that do not employ a pressure regulating chamber.

In some examples, the fan chamber 115 and the pressure regulating chamber can be in fluidic communication without any intervening components (i.e., in the absence of any intervening components). Examples of intervening components include valves or baffles. As mentioned, having the fan chamber 115 and the pressure regulating chamber in fluid communication without any intervening components can promote aspects of pressure regulating chambers herein such as readily promoting the flow of a fluid between the pressure regulating chamber 116 and the fan chamber 115 to reduce a pressure gradient experienced in the fan chamber 115 during operation of the fan 103.

While FIG. 1 illustrates an individual pressure regulating chamber it is understood that a total number, shape, and/or location of the pressure regulating chamber, among other items, can be varied. For instance, an electronic device can include a plurality of pressure regulating chambers (not illustrated in FIG. 1). Each pressure regulating chamber in the plurality of pressure regulating chambers can be the same shape/size and/or can be different shapes/sizes, for instance, to accommodate use of the pressure regulating chambers in various types/sizes of electronic devices and yet reduce a pressure gradient in fans within the various electronic devices.

Figure 2B:
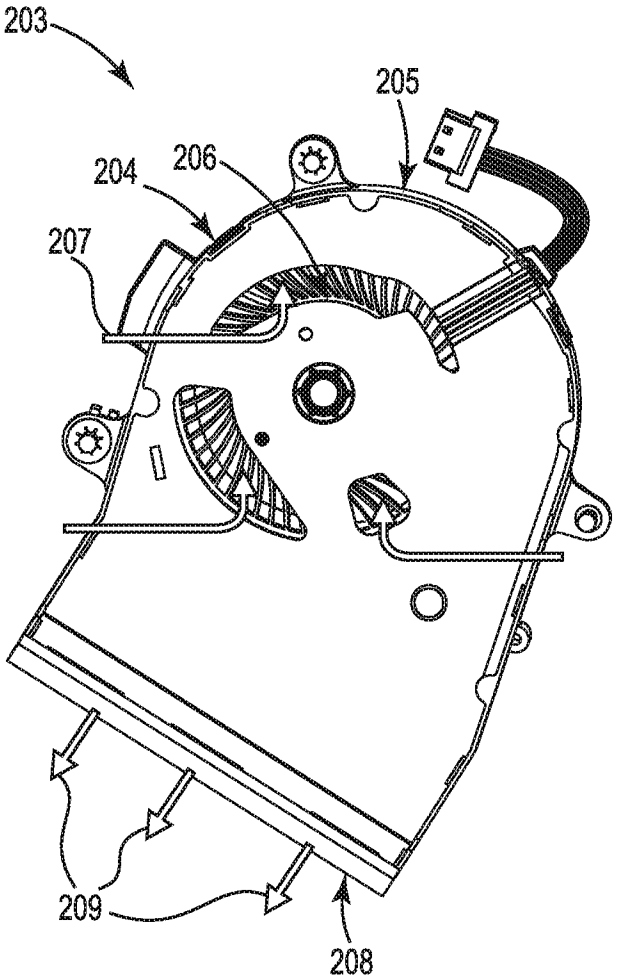
FIG. 2B is a further view of an example fan including a pressure regulating chamber.
Figure 2A:
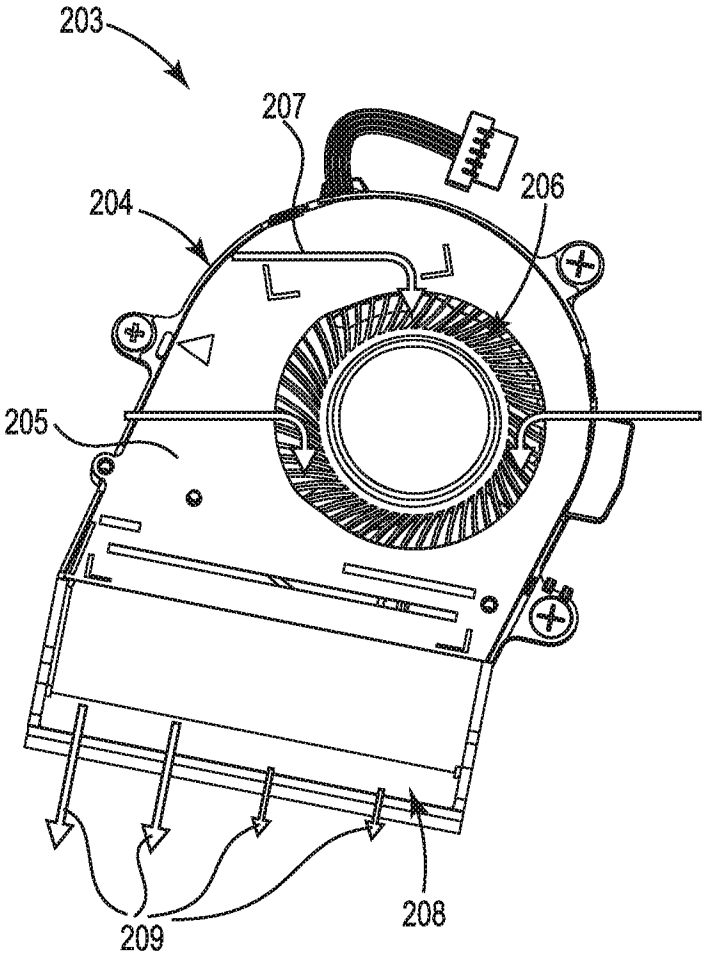
FIG. 2A is a view of an example fan including a pressure regulating chamber.

FIG. 2A is a view (a top view) of an example fan 203 including a pressure regulating chamber. As illustrated in FIG. 2, the fan 203 can include an fan body 204 which includes a surface 205 that defines an inlet 206 of the fan 203. In some example, the inlet 206 can be included in a cover 205. The cover 205 can overlay and partially obstruct a fan chamber in which an impeller is disposed. In any case, the inlet 206 can permit a fluid to flow into the fan 203.

The surface 205 of the fan body 204 can also define an outlet 208 of the fan 203. The outlet 208 can permit a fluid to flow out of the fan 203. The inlet 206 can be in fluidic communication with the outlet 208. For instance, a fluid flow path can extend from the inlet 206 to the outlet 208. For example, air (as represented by element 207) can flow into the inlet 206, move through a fan chamber and into a pressure regulating chamber in the fan body 204, and exit the fan chamber and the fan body 204 as air 209 via the outlet 208. Note, various components such as a fan chamber and a pressure regulating chamber which are included in the fan 203 are not illustrated in FIG. 2A and FIG. 2B for ease of illustration. Having the pressure regulating chamber located in the fan body 204 between the inlet 206 and the outlet 208 can reduce pressure gradient experienced in the fan 203 (e.g., in a fan chamber 315 as illustrated in FIG. 3) during operation of the fan 203, as detailed herein.

FIG. 2B is a further view (a bottom view) of an example fan 203 including a pressure regulating chamber. As illustrated in FIG. 2B, the fan 203 can include an inlet 206 and an outlet 208. As mentioned, the inlet 206 and the outlet 208 can be in fluidic communication along a fluid flow path between the inlet 206 and the outlet 208. For instance, as mentioned air (as represented by element 207) can flow into the inlet 206, move through a fan chamber and into a pressure regulating chamber in the fan body 204, and exit the fan chamber and the fan body 204 (as the air represented by element 209) via the outlet 208. In this way the fan can impart a flow in the air such that the air 209 can cool an electronic device.

As illustrated in FIG. 2A and FIG. 2B the fan 203 can include a plurality of inlets (e.g., inlet 206) and an individual outlet (e.g., outlet 208). However, a total number, size, orientation, and/or other aspects of the inlet and outlet can be varied. For instance, in some examples, the fan can include a plurality of outlets. In such instances, the fan 203 can include a plurality of pressure regulating chambers such that each outlet of the plurality of outlets has a corresponding pressure regulating chamber. In this way, noise attributable to each flow path associated with each outlet can be reduced due to the presence of a corresponding pressure regulating chamber along each flow path.

FIG. 3 is another view (another top view) of an example fan 303 including a pressure regulating chamber 316. FIG. 3 illustrates fan 303 without a cover (e.g., cover 205 as illustrated in FIG. 2A) such that the pressure regulating chamber 316 is visible.

As illustrated in FIG. 3, the pressure regulating chamber 316 can be positioned along a fluid flow path (as represented by element 311) that extends from an inlet (e.g., inlet 206 as illustrated in FIG. 2A and FIG. 2B) to an outlet 308 of the fan 303. As illustrated in FIG. 3, a fluid such as air can flow along the fluid flow path 311 in a direction that is the same as a direction of rotation of an impeller 310. For instance, air (represented by element 307) can be drawn by way of rotation of the impeller 310 into the inlet, pushed by blades or other elements of the impeller along the fluid flow path 311, and caused to exit via the outlet 308 as air (represented by 309).

Figure 4:
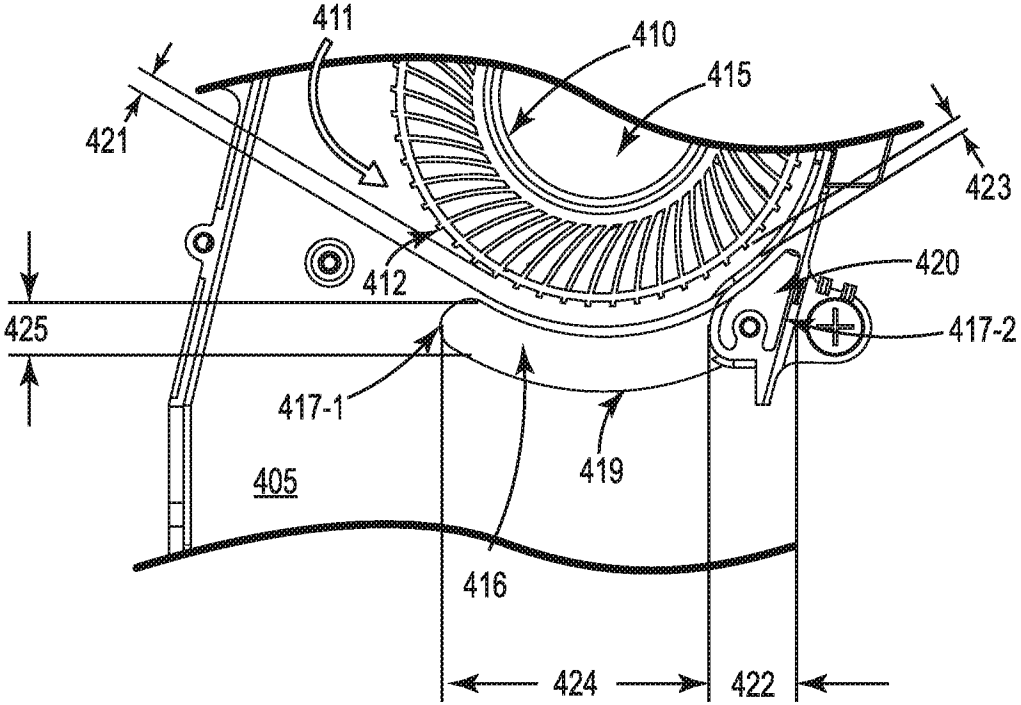
FIG. 4 is a portion of the additional view of the example fan including a pressure regulating chamber.

FIG. 4 is a portion of the further view of the example fan (e.g., a portion of fan 303 as illustrated in FIG. 3) including a pressure regulating chamber 416. In some examples, the pressure regulating chamber 416 can be elongated, as illustrated in FIG. 4. As used herein an elongated pressure regulating chamber refers to a physical feature which has a longer length (e.g., length 424) than a width (e.g., width 425). The length 424 of the chamber refers to a length of the portion of the chamber that extends from an opening 420 and is enclosed. In some instances, the length 424 can be in a range from 10:1 to 1.5:1 relative to the width of the pressure regulating chamber 416. All individual values and sub-ranges from 10:1 to 1.5:1 are included. For instance, the length 424 can be from 10:1, from 5:1, from 3:1, from 2:1, or from 1.5:1 relative to the width 425 of the pressure regulating chamber, among other possible values/ratios.

The pressure regulating chamber 416 includes an inner surface 419 that defines a volume of the pressure regulating chamber. The inner surface 419 can include an opening 420 in the pressure regulating chamber 416. The opening 420 is in fluidic communication with the fan chamber 415. For instance, the opening 420 can be positioned adjacent to a fluid flow path (e.g., fluid flow path as represented by element 411) in the fan chamber 415. As used herein, being adjacent refers to being adjacent with respect to a direction lateral along a surface 405 and a depth within the surface such that the opening to the pressure regulating chamber is in fluidic communication with the fan chamber. Thus, fluid can flow along the fluid flow path 411 and in/out of the opening 420. As mentioned, having the opening 420 be in fluidic communication can reduce a pressure gradient within the fan chamber/along the fluid flow path 411.

In some examples, the pressure regulating chamber 416 can extend into the surface of the fan body in a direction that is substantially opposite of a direction of the fluid flow path (e.g., a direction of the fluid flow path taken at the closest point relative to the opening 420), as illustrated in FIG. 4. Having the opening be adjacent to the fluid flow path and/or having the pressure regulating chamber 416 extend in a direction that is substantially opposite of the direction of the fluid flow path can promote flow of the fluid along the fluid flow path 411, and yet can permit fluid flow in/out of the opening 420 of the pressure regulating chamber 416.

As used herein, the term "substantially" intends that the characteristic may not be absolute, but is close enough so as to achieve the intent of the characteristic. For example, "substantially in an opposite direction" are not limited to values that are absolutely at a 180 degree angle. For instance, the pressure regulating chamber can extend in a direction that is within 0.5%, 1%, 2%, 5%, 10%, 20% or 25% etc. of a 180 degree angle with respect to the direction of the fluid flow path.

In some examples, the inner surface 419 can be a continuous such that the opening 420 is the sole orifice or passage into a volume of the pressure regulating chamber 416. Having the inner surface 419 be a continuous (e.g., with the opening 420 as the sole opening) can promote aspects herein such as reduction of a pressure gradient during operation of a fan and/or reduction of fan noise during operation of the fan.

The inner surface 419 can define length 424 and a width 425 of the pressure regulating chamber 416. As illustrated in FIG. 4, in some examples, the width 425 can be uniform (the same numerical value) along a length 424 of the pressure regulating chamber 416.

However, in some instances, the width 425 can vary along the length 424 of the pressure regulating chamber 416. For instance, in some examples the width can vary in a repeating pattern (e.g., a sinusoidal pattern) or irregularly along the length 424 of the pressure regulating chamber 416.

The pressure regulating chamber 416 can be hollow. For instance, the pressure regulating chamber can be a hollow pressure regulating chamber having a volume that is defined by the inner surface 419 of pressure regulating chamber 416. However, in some instances, baffles or other structures can be included in the pressure regulating chamber 416.

In some examples, a width 422 of the opening 420 of the pressure regulating chamber 416 can be less than the length 424 of the pressure regulating chamber. For instance, the length 424 of the pressure regulating chamber 416 can be in a range from 1.5 to 5.0 times the width 422 of the opening 420. All individual values and sub-ranges from 1.5 to 5.0 are included. For example, the length 424 of the pressure regulating chamber 416 can be 1.5, 2.0, 2.5, 3.0, 3.5, 4.0, 4.5, or 5.0 times the width 422 of the opening. Having the width of the opening of the pressure regulating chamber be less than the length of the pressure regulating chamber can promote aspects of pressure regulating chambers herein.

In some examples, the pressure regulating chamber 416 can be curved (i.e., a curved pressure regulating chamber). For instance, as illustrated in FIG. 4. the pressure regulating chamber 416 can be curved such that the pressure regulating chamber 416 is banana shaped or arcuate. However, other types of curved structures are possible. In some examples, a pressure regulating chamber 416 can be curved in a direction that follows a contour of a fan chamber 415. Stated differently, the pressure regulating chamber 416 can be concentric to (i.e., curve around) the fan chamber 415, as illustrated in FIG. 4. Having the pressure regulating chamber be concentric to the fan chamber can promote pressure gradient reduction in the fan and can ease incorporation of the pressure regulating chamber into the fan. However, other shapes such as the pressure regulating chamber being angled or straight (with respect to the fan chamber) are possible.

The pressure regulating chamber 416 can include a first distal end 417-1 a second distal end 417-2 which are located at or near opposite ends along the length 424 of the pressure regulating chamber 416. The first distal end 417-1 can be located a first distance 421 from a distal portion 412 of a rotational element 410, while the second distal end 417-2 can be located a second distance 423 from the distal portion 412 of the rotation element 410.

In some examples, the first distance 421 can be greater than or equal to the second distance 423. For instance, as illustrated in FIG. 4, the first distance 421 can be greater than the second distance 423. For instance, in some examples the first distance 421 can be less than or equal to four times the second distance 423. Having the first distance 421 be greater than the second distance 423 can promote aspects of pressure reduction chambers herein.

In some examples, the pressure regulating chamber 416 can be smaller than the fan chamber 415. For instance, in some examples a volume of the pressure regulating chamber 416 can be less than a volume of the fan chamber 415. For example, a volume of the pressure regulating chamber 416 can be from five percent to 90 percent of a volume of a fan chamber. All individual values and sub-ranges from 5 percent to 90 percent are included. For instance, in some examples a volume of the pressure regulating chamber 416 can be 5 percent, 15 percent, 30 percent, 50 percent, 75 percent, or 90 percent of a volume of the fan chamber 415.

Figure 5:
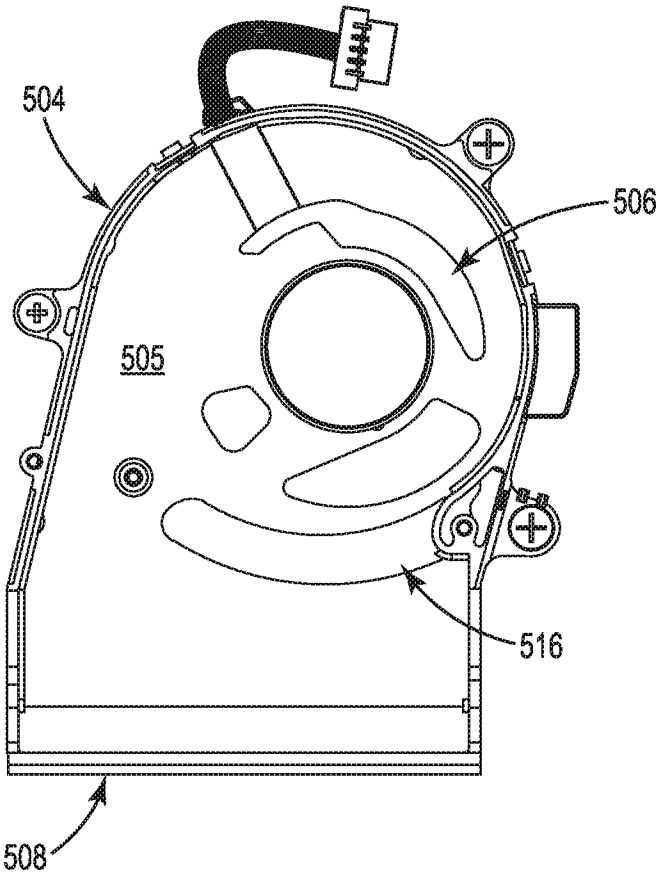
FIG. 5 is a view of an example fan body including a pressure regulating chamber.

FIG. 5 is a view of an example fan body 504 including a pressure regulating chamber 516. Fan body 504 can include a surface 505 that defines an inlet 506, an outlet 508, and the pressure regulating chamber 516, as described herein. The fan can be electrically coupled to an electronic device via a wire or cable. In some examples, the cable can be a flexible cable that electrically couples that fan body 504 to the electronic device.

The figures herein follow a numbering convention in which the first digit corresponds to the drawing figure number and the remaining digits identify an element or component in the drawing. Similar elements or components between different figures may be identified by the use of similar digits. For example, 104 may reference element "04" in FIG. 1, and a similar element may be referenced as 204 in FIG. 2A.

Elements shown in the various figures herein may be capable of being added, exchanged, and/or eliminated so as to provide a number of additional examples of the disclosure. In addition, the proportion and the relative scale of the elements provided in the figures are intended to illustrate the examples of the disclosure and should not be taken in a limiting sense.

The above specification and examples provide a description of the method and applications and use of the system and method of the present disclosure. Since many examples can be made without departing from the scope of the system and method, this specification merely sets forth some of the many possible example configurations and implementations.

What is claimed is:

1. A fan body, comprising:

a surface defining a fan chamber having volume that extends from an inlet of the fan chamber to an outlet of the fan chamber;
and a hollow pressure regulating chamber extending into the surface defining the fan chamber to provide an additional volume and having an opening to the additional volume of the hollow pressure regulating chamber that is in fluidic communication with the volume of the fan chamber to permit fluid flow between the volume of the fan chamber and the additional volume to regulate a pressure of fluid in the volume of the fan chamber.

2. The fan body of claim 1, wherein the hollow pressure regulating chamber is elongated.

3. The fan body of claim 1, wherein the hollow pressure regulating chamber is in fluidic communication with the fan chamber without any intervening components between the hollow pressure regulating chamber and the fan chamber.

4. The fan body of claim 1, wherein the hollow pressure regulating chamber is concentric to the fan chamber curved.

5. The fan body of claim 1, wherein the hollow pressure regulating chamber includes an inner surface defining the additional volume of the hollow pressure regulating chamber.

6. The fan body of claim 5, wherein the additional volume of the hollow pressure regulating chamber is less than the volume of the fan chamber.

7. The fan body of claim 1, wherein the opening of the hollow pressure regulating chamber is adjacent to a fluid flow path extending from the inlet of the fan chamber to the outlet of the fan chamber and extends laterally into the surface defining the fan chamber.

8. A fan comprising:

a fan body including a surface defining a fan chamber having volume that extends from an inlet of the fan chamber to an outlet of the fan chamber:
and a hollow pressure regulating chamber extending into the surface defining the fan chamber to provide an additional volume in addition to the volume of the fan chamber, and having an opening that is positioned adjacent to a fluid flow path extending from the inlet of the fan chamber to the outlet of the fan chamber and is in fluidic communication with the volume of the fan chamber to permit fluid to flow between the volume of the fan chamber and the additional volume to regulate a pressure of fluid in the volume of the fan chamber; and a rotational element disposed in the fan chamber.

9. The fan of claim 8, wherein:

a first distal end of the hollow pressure regulating chamber is located a first distance from a distal portion of the rotational element; and a second distal end of the hollow pressure regulating chamber is located a second distance from the distal portion of the rotation element, and wherein the first distance is greater than or equal to the second distance.

10. The fan of claim 9, wherein the first distance is greater than the second distance.

11. The fan of claim 10, wherein the first distance is less than or equal to four times the second distance.

12. The fan of claim 8, wherein a width of the opening of the hollow pressure regulating chamber is less than a length of the hollow pressure regulating chamber.

13. The fan of claim 12, wherein the length of the hollow pressure regulating chamber is in a range from 1.5 to 5.0 times the width of the opening.

14. The fan of claim 8, wherein the hollow pressure regulating chamber is concentric to the fan chamber.

15. An electronic device comprising:

a heat-generating component; and a fan including:

a fan body having a surface defining a volume of a fan chamber extending from an inlet of the fan chamber to an outlet of the fan chamber;

a curved hollow pressure regulating chamber extending into the surface defining the fan chamber to provide an additional volume in addition to the volume of the fan chamber, and having an opening that is positioned along a fluid flow path extending from the inlet of the fan chamber to the outlet of the fan chamber that is in fluidic communication with the volume of the fan chamber and the additional volume to permit fluid flow between the volume of the fan chamber and the additional volume to regulate a pressure of fluid in the volume of the fan chamber, wherein the curved hollow pressure regulating chamber extends into the surface of the fan chamber in a direction that is substantially opposite of a direction of the fluid flow path; and a rotational element disposed in the fan chamber to receive a fluid via the inlet of the fan chamber and cause the fluid to flow along the fluid flow path to the outlet of the fan chamber.

16. The electronic device of claim 15, wherein the opening of the curved hollow pressure regulating chamber is adjacent to the fluid flow path.

17. The electronic device of claim 15, wherein the curved hollow pressure regulating chamber is concentric to the fan chamber.

* * * * *